US006060871A

United States Patent [19]

Barker

[11] Patent Number: 6,060,871

[45] Date of Patent: May 9, 2000

[54] STABLE VOLTAGE REGULATOR HAVING FIRST-ORDER AND SECOND-ORDER OUTPUT VOLTAGE COMPENSATION

[75] Inventor: Richard J. Barker, Stockport, United Kingdom

[73] Assignee: U.S. Philips Corporation, New York, N.Y.

[21] Appl. No.: 09/174,222

[22] Filed: Oct. 16, 1998

[30] Foreign Application Priority Data

Oct. 17, 1997 [GB] United Kingdom ..... 972108

[51] Int. Cl.[7] ..... G05F 1/40

[52] U.S. Cl. ..... 323/280; 323/273; 323/281

[58] Field of Search ..... 323/273, 274, 323/280, 281, 289

[56] References Cited

U.S. PATENT DOCUMENTS

| | | | |
|---|---|---|---|
| Re. 35,261 | 6/1996 | Nelson | 323/280 |
| 4,260,946 | 4/1981 | Wheatley | 323/314 |
| 4,929,884 | 5/1990 | Bird et al. | 323/313 |
| 5,336,943 | 8/1994 | Kelly et al. | 307/310 |
| 5,506,539 | 4/1996 | Kelly et al. | 327/379 |
| 5,548,205 | 8/1996 | Monticelli | 323/280 |
| 5,559,424 | 9/1996 | Wrathall et al. | 323/280 |
| 5,563,760 | 10/1996 | Lowis et al. | 361/103 |
| 5,578,960 | 11/1996 | Matsumura et al. | 327/535 |
| 5,625,278 | 4/1997 | Thiel et al. | 323/280 |
| 5,637,992 | 6/1997 | Edwards | 323/280 |
| 5,686,820 | 11/1997 | Riggio, Jr. | 323/280 |
| 5,686,821 | 11/1997 | Brokaw | 323/273 |
| 5,774,021 | 6/1998 | Szepesi et al. | 323/285 |

*Primary Examiner*—Peter S. Wong
*Assistant Examiner*—Bao Q. Vu
*Attorney, Agent, or Firm*—Steven R. Biren

[57] ABSTRACT

A stable voltage regulator circuit of simple circuit configuration 174,222 includes a differential amplifier (M2, M3) which is powered from a supply line (1) at a nominal voltage level (Vin), by being coupled between the supply line and a return line (2). A reference device (M1) is coupled to a first input (4) of the differential amplifier (M2, M3) for defining a desired output voltage (Vca) on an output line (3) coupled to an output (6) of the differential amplifier (M2, M3). The differential amplifier (M2, M3) is coupled to the return line (2) by a varying current source (M4) which feeds a varying bias current to the differential amplifier (M2, M3) and which is controlled from the supply line (1) in accordance with variations in the nominal voltage level (Vin) on the supply line (1). The varying bias current to the differential amplifier (M2, M3) provides a first-order compensation of the output voltage (Vca) for these voltage variations on the supply line (1). A second-order compensation is provided by a feedback coupling (R7, R8) from the output line (3) to the second input (5) of the differential amplifier (M2, M3).

10 Claims, 3 Drawing Sheets

STABLE VOLTAGE REGULATOR HAVING FIRST-ORDER AND SECOND-ORDER OUTPUT VOLTAGE COMPENSATION

BACKGROUND OF THE INVENTION

This invention relates to voltage regulator circuits, particularly but not exclusively suitable for integration with semiconductor circuit elements in a semiconductor circuit device and able to provide a stable regulated voltage supply for these circuit elements. The semiconductor circuit elements may be part of, for example, a control circuit and/or protection circuit of a power semiconductor device (for example, a power MOSFET device or a power IGBT device) or part of a monolithic analog or digital integrated circuit.

United States Patent Specification U.S. Pat. No. 4,260,946 discloses various configurations of voltage regulator circuit for deriving a desired output voltage from a supply line at a nominal voltage level, some of the circuits requiring operational amplifiers. The voltage regulator circuit of FIG. 5 of U.S. Pat. No. 4,260,946 comprises a differential amplifier powered from a supply line at the nominal voltage level, by being coupled between the supply line and a return line. A reference device (of a particular type in U.S. Pat. No. 4,260,946) is coupled to a first input of the differential amplifier for defining the desired output voltage signal on an output line coupled to an output of the differential amplifier. There is feedback coupling from the output line to a second input of the differential amplifier. In the regulator circuit of FIG. 4 of U.S. Pat. No. 4,260,946, both the differential amplifier and the reference device are supplied from the output line at the desired output voltage level, by being coupled between the output line and the return line. In all the circuits of U.S. Pat. No. 4,260,946, the amplifier is grounded by the return line at ground potential. The whole contents of U.S. Pat. No. 4,260,946 are hereby incorporated herein as reference material.

SUMMARY OF THE INVENTION

It is an aim of the present invention to provide a voltage regulator circuit having good stability but with a simple circuit configuration which can be integrated in a small layout area of a semiconductor circuit device, for example a monolithic integrated circuit and/or a protected power semiconductor device.

According to the present invention there is provided a voltage regulator circuit comprising a differential amplifier powered from a supply line at a nominal voltage level by being coupled between the supply line and a return line, a reference device coupled to a first input of the differential amplifier for defining a desired output voltage on an output line coupled to an output of the differential amplifier, and a feedback coupling from the output line to a second input of the differential amplifier, characterised in that the differential amplifier is coupled to the return line by a varying current source which feeds a varying bias current to the differential amplifier, and the varying current source has control means coupled to the supply line for controlling the magnitude of the varying bias current in accordance with variations in the nominal voltage level on the supply line and so to provide a first-order compensation of the output voltage for these variations in the nominal voltage level, a second-order compensation being provided by the feedback coupling from the output line to the second input of the differential amplifier.

A voltage regulator circuit having good stability is obtained in this way, by feeding a varying bias current to the differential amplifier to provide a first-order compensation for the variations in the nominal supply voltage level, and by using the feedback coupling from the output line to provide the second-order compensation. Furthermore this good stability can be realised with a simple circuit configuration which does not require a high gain and which can be integrated in a small layout area of a semiconductor circuit device.

Although the regulator circuit may be formed using bipolar transistor technology, there is generally nowadays a preference to use insulated-gate field-effect transistor (so-called "MOST") technology for semiconductor circuit integration. The present invention is readily realisable using MOST technology.

Thus, the varying current source may comprise a MOST having its main current path coupled between the supply line and return line and having its gate forming the control means of the varying current source. This MOST may be coupled in a current mirror configuration with a diode-connected MOST. The diode-connected MOST may have its main current path coupled in an impedance path between the supply line and return line for deriving a varying reference current in accordance with variations in the nominal voltage level on the supply line. Thus, the variation in magnitude of the bias current of the differential amplifier can be determined by the variation in magnitude of the reference current in the impedance path.

The reference device may comprise a diode-connected MOST having its main current path coupled in series with a resistance (preferably between the output line and return line) so as to operate in an area of its square law region. In this way a very stable output voltage which is substantially independent of temperature and which is of quite a high value can be obtained. However other, known types of temperature-stable reference device may alternatively be used to provide a temperature-independent reference voltage in a regulator circuit configured in accordance with the present invention. Furthermore, if the regulated output voltage is desired to have additional and/or different characteristics to a particular temperature-range independence, then the properties of the reference device can be chosen accordingly.

The output line may be derived from the output of the differential amplifier via a source-follower MOST having its gate coupled to the output of the differential amplifier. This source-follower MOST may have its main current path coupled between the supply line and output line.

The differential amplifier may comprise a differential pair of MOSTs. Each MOST of the differential pair may have its main current path coupled between the supply line and return line via the varying current source, and each MOST may have its gate coupled to a respective one of the first and second inputs of the differential amplifier. This arrangement provides a simple differential amplifier configuration which requires only a small layout area for its integration but which can provide sufficient gain in the context of the present invention. However, if a higher specification is desired, a more complex amplifier design may be adopted in a circuit in accordance with the invention. Thus, for example, the differential amplifier may comprise two or more, cascaded amplifier stages, not all of which are coupled between the supply line and return line via the varying current source. In a 2-stage amplifier, the first stage comprises the first and second inputs of the differential amplifier, whereas the output of the differential amplifier is derived from an output of this second stage. In this example, it may be that only the second stage is powered from the supply line, by being coupled between the supply line and return line via the varying current source. The first stage may be powered from the output line by being coupled between the output line and the return line. However, it is also possible to power both the first and second stages from the supply line. Thus, each stage may be coupled between the supply line and return line via a respective varying current source having control means coupled to the supply line for controlling the magnitude of a respective bias current to that stage in accordance with variations in the nominal voltage level on the supply line.

BRIEF DESCRIPTION OF THE DRAWING

These and other features in accordance with the present invention are illustrated specifically in embodiments of the invention now to be described, by way of example, with reference to the accompanying drawings, in which.

DESCRIPTION OF THE PREFERRED EMBODIMENTS

Figure 1:
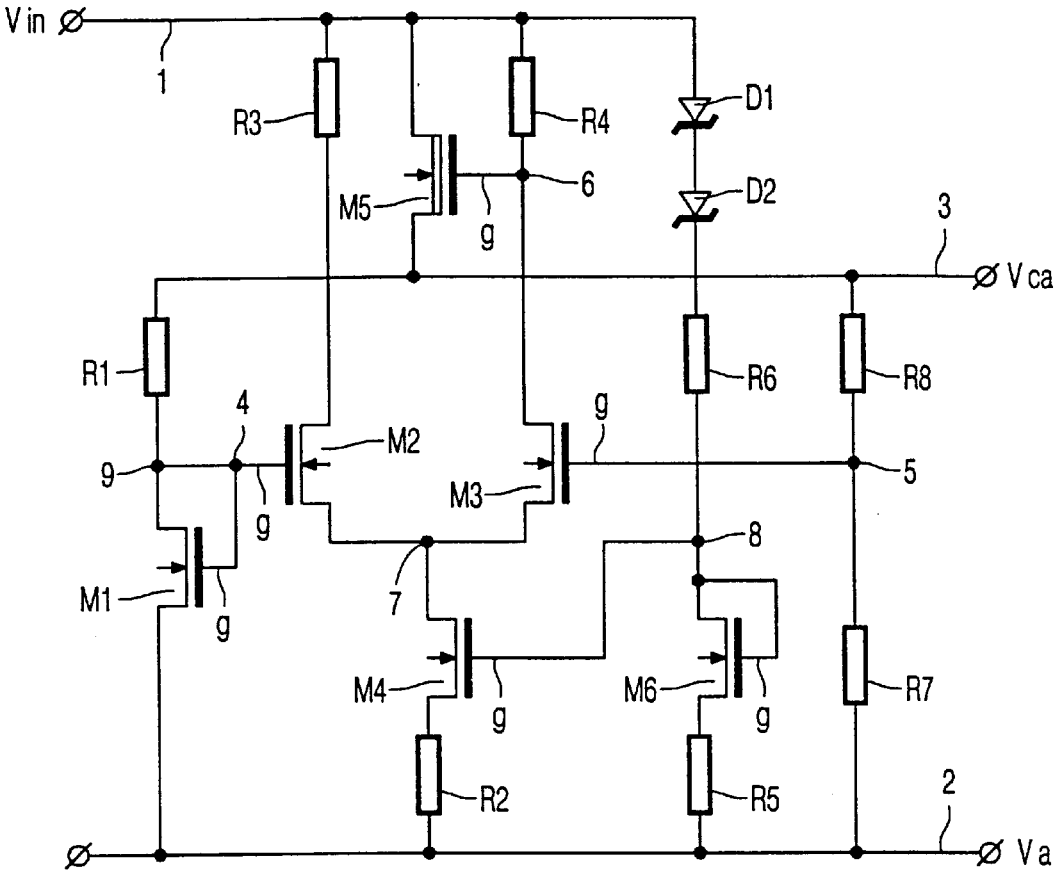
FIG. 1 is circuit diagram of one embodiment of a voltage regulator circuit in accordance with the present invention.

The voltage regulator circuit of FIG. 1 comprises a differential amplifier M2, M3 powered from a supply line 1 at a nominal voltage level Vin, by being coupled between the supply line 1 and a return line 2. A reference device M1 is coupled to a first input 4 of the differential amplifier M2, M3. This reference device M1 defines a desired output voltage Vca on an output line 3 coupled to an output 6 of the differential amplifier. The differential amplifier M2, M3 is coupled to the return line 2 by a varying current source M4 which feeds a varying bias current to the differential amplifier M2, M3. This bias current may also be termed a "tail" current, as it is supplied to the differential amplifier M2, M3 from its coupling to the return line 2. The varying current source M4 has control means g coupled to the supply line 1 for controlling the magnitude of the varying bias current in accordance with variations in the nominal voltage level Vin on the supply line. In this way, the varying current source M4 provides a first-order compensation of the output voltage signal Vca for these variations in the supply voltage Vin. A second-order compensation is provided by the feedback coupling from the output line 3 to a second input 5 of the differential amplifier M2, M3.

This voltage regulator circuit may be used in a wide variety of applications. One particular application of considerable interest is for regulating an internal voltage supply for powering a protection circuit or other type of control circuit, which is integrated with a power semiconductor device. Particular examples of such protection and/or control circuits are disclosed in, for example, United States patent specifications U.S. Pat. No. 5,563,760, U.S. Pat. No. 5,506,539, U.S. Pat. No. 5,336,943 and U.S. Pat. No. 4,929,884 (our references PHB 33667, PHB 33904, PHB 33762 and PHB 33363), the whole contents of which are hereby incorporated herein as reference material. The power semiconductor devices may be, for example, switches which are used for switching lamps or other loads in an automotive environment. The voltage supply in an automotive application is derived from a vehicle battery, and considerable fluctuations (e.g. up to 50%) can occur in the nominal supply voltage level Vin. Furthermore, considerable fluctuations in circuit temperature can occur in an automotive application (both in normal operation and in fault conditions, e.g. if the load becomes short-circuited), and so it is generally desirable in this environment to provide a voltage regulator output Vca which is substantially independent of the circuit temperature over a given range in the circuit application.

In a particular example (to which FIGS. 2 and 3 relate), the desired regulated output voltage Vca on line 3 may be 2.75V, with a typical variation of less than ±0.10V (i.e. a change of less than 7% in Vca). The supply voltage Vin on line 1 may be in the range of 4V to 20V, for example about 5V, and the line 2 may be grounded (i.e. Va=0V). The circuit may operate over a temperature range from ambient to, for example, 160° C. In the particular example of FIGS. 2 and 3 and with the n-channel MOST process technology used, the reference device M1 provides a reference voltage Vref of about 1.3V at the input 4 of the differential amplifier M2, M3.

In the FIG. 1 circuit, the reference device M1 is a diode-connected MOST having its main current path coupled in series with a resistance R1 between the output line 3 and the return line 2. The resistance value of R1 is chosen so as to operate M1 at a suitable current density in its square law region where the temperature coefficient of the voltage Vref across M1 is approximately zero. The operation of a diode-connected MOST as a voltage reference having a zero temperature coefficient is already disclosed in U.S. Pat. No. 5,336,943 in the context of a temperature sensing circuit. As described in U.S. Pat. No. 5,336,943, the temperature coefficient will be positive at higher current densities and negative at lower current densities. In the FIG. 1 circuit, M1 is operated so as to have a zero temperature coefficient over the temperature range of interest (for example, 20° C. to 160° C., so that the regulated output Vca is also substantially independent of temperature over this temperature range. This temperature-independent voltage reference device M1 is coupled by its common gate-drain terminal to the first input 4 of the differential amplifier M2, M3. The feedback coupling from the output line 3 to the second input 5 of the differential amplifier M2, M3 is derived from a potential divider (of series resistors M7 and M8) coupled between the output line 3 and the return line 2.

The circuit of FIG. 1 is realised using MOST (i.e. insulated-gate field-effect transistor) technology. The circuit is based on a simple MOST differential pair M2, M3 followed directly by a source follower MOST M5. Thus, the differential amplifier in FIG. 1 comprises a long-tailed pair of MOSTs M2 and M3, each having its main current path coupled at its drain terminal to the supply line 1 by a respective resistor R3 and R4 and coupled at its source terminal to the return line 2 via the varying current source M4. M2 and M3 each has its respective gate g providing a respective one of the first and second inputs 4 and 5 of this differential amplifier M2, M3. The resistance values of R3 and R4 can be chosen so as to operate M2 and M3 in known manner in their sub-threshold region. The output 6 of the differential amplifier M2, M3, is the series node of M3 and R4 in the FIG. 1 example. The output line 3 is derived from the output 6 of this differential amplifier M2, M3 via the source-follower MOST M5. M5 has its gate g coupled to this output 6. The main current path of M5 is coupled between the supply line 1 and the output line 3.

Under normal operation, the gain of such a simple amplifier arrangement (a simple differential pair M2, M3 followed directly by a source-follower M5) would not be adequate to correct for large changes in the nominal supply voltage Vin which may often occur, for example in automotive circuits. However, in the circuit configuration of FIG. 1, this simple circuit arrangement of M2, M3 and M5 is able to correct for these large voltage changes in Vin, by means of the appropriately varying bias (tail) current to the differential pair M2, M3. This bias current is controlled by the varying current source M4 such that the current through M3 and R4 is approximately proportional to the headroom of the regulator circuit; this headroom is the difference between the voltage level of the input voltage Vin and that of the output voltage Vca.

When the output voltage Vca is in the regulation condition, the voltage across R4 is equal to the difference between the regulator headroom and the threshold voltage of M5. By suitably choosing the MOST technology and dimensions, it can be arranged that the voltage across R4 becomes approximately equal to the regulator headroom. As the current in R4 is proportional to the voltage across R4, then the current in R4 will be proportional to the headroom. There are two possible mechanisms for causing the current in R4 to vary. One mechanism is to use (via input 5) an error signal from the differential amplifier M2, M3 to switch the current balance from one MOST of the differential pair M2 and M3 to the other MOST. The other mechanism is to change the magnitude of the bias (tail) current to M2, M3 through M4, leaving unchanged the current balance through M2 and M3. In this case, as the balance of M2 and M3 remains essentially unchanged (i.e. the same ratio of currents through M2 and M3 is maintained), no error in the signal at node 5 is required to support this change in the current through R4. Thus, this variation in tail current (via M4 in accordance with variations in Vin) can be made to ensure that the tail node 7 of the differential pair M2, M3 (and hence also the output 6) remain at approximately constant voltage, before and independent of any control loop corrections via node 5. The present invention uses this variation in tail current to provide the first-order compensation for variations in Vin.

The varying current source M4 of the FIG. 1 circuit is a MOST having its main current path coupled between the tail node 7 of the differential amplifier M2, M3 and the return line 2. A series resistor R2 couples M4 to the return line 2. M4 is coupled in a current mirror configuration with a diode-connected MOST M6 which is similarly coupled to the return line 2 by a series resistor R5. The diode-connected MOST M6 has its main current path coupled in an impedance path (comprising a resistor R6, which is in series with diodes D1, D2 as well as R5 and R6) between the supply line 1 and the return line 2 for deriving a varying reference current. This reference current in the impedance path R6 (+D1, D2, M6, R5) varies in accordance with variations in the nominal voltage level Vin on the supply line 1. The magnitude of the bias current supplied to the differential amplifier M2, M3 is controlled by means of the gate g of M4 which is coupled to the node 8 of R6 and M6 in this impedance path. Thus, the variation in magnitude of the bias current of the differential amplifier M2, M3 is determined by the variation in magnitude of the reference current in the impedance path R6, (+D1, D2, M6, R5).

Thus, FIG. 1 shows an example of a circuit in which the magnitude of the varying tail current to the differential amplifier is defined by a current mirror M4, M6 fed with a reference current generated by a resistor R6 from the input supply voltage Vin, minus the diode forward voltage drop across D1 and D2 and the MOS threshold of M6. The resistance values of R2 and R5 are chosen compatible with the desired mirror ratio for M4 and M6 and with reliable operation of the differential pair M2 and M3. The sum of the threshold voltages across D1, D2 and M6 should approximate to the magnitude of the regulated output voltage Vca. Thus, the voltage drop across (R6+R5) is approximately proportional to the regulator headroom (Vin−Vca). Normally, the resistance value of R6 (and hence its voltage drop) will be significantly larger than that of R5. By so choosing the values of these components of the impedance path. The magnitude of the reference current is so arranged that, with the differential amplifier M2, M3 in its balanced condition, the output at node 6 is maintained at approximately a constant voltage irrespective of variations in the supply voltage Vin.

Because the first order algorithmic correction (by means of the changing tail current) compensates for most of the variation in Vin, the closed loop gain of the system (as provided for the feedback from the output line 3 to the second input 5) merely serves to compensate for errors in the first order error correction. Thus, the closed loop gain of the simple circuit configuration of M2, M3 and M5 does not compensate directly for the errors (i.e. variations) in Vin.

Figure 2:
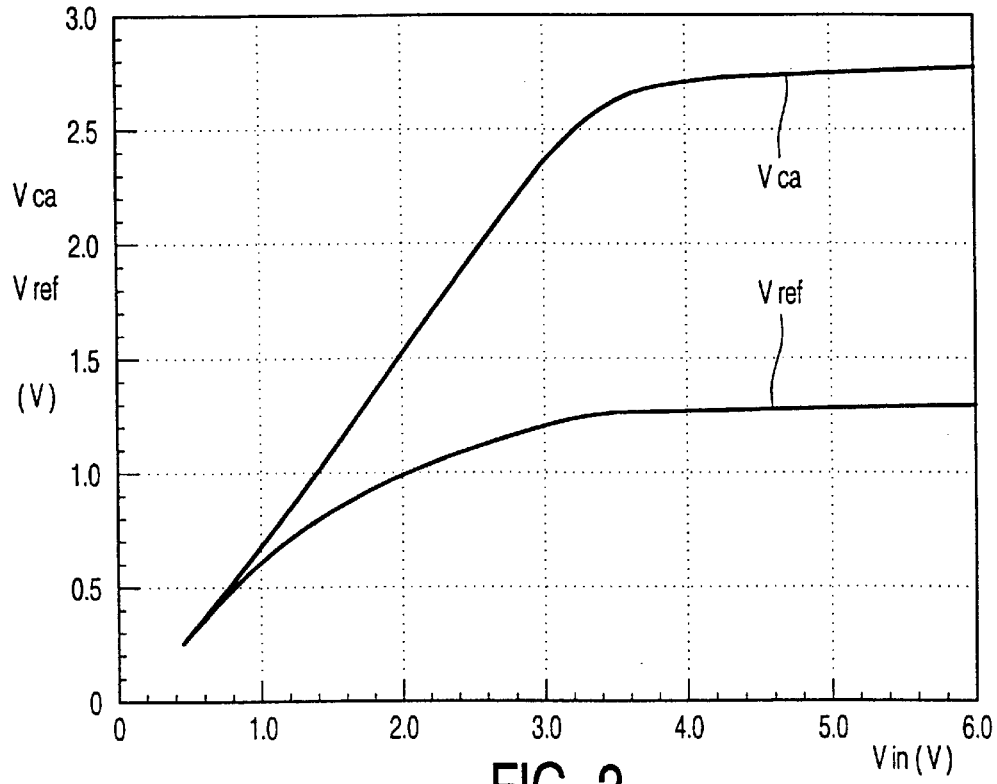
FIG. 2 is a graph showing the variation in reference voltage Vref and output voltage Vca(both in volts) with supply voltage Vin (also in volts), for the circuit of FIG 1.
Figure 3:
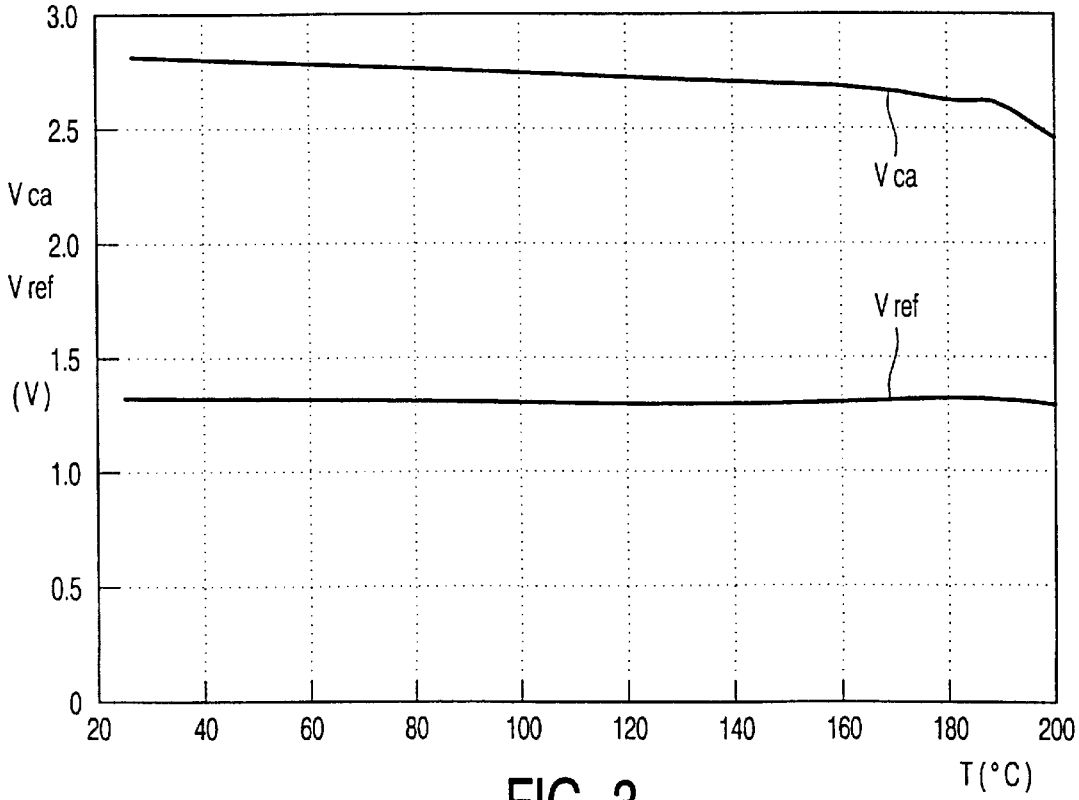
FIG. 3 showing the very slight variation which occurs in the reference voltage Vref and output voltage Vca in volts, with the FIG. 1 circuit temperature in °C. (degrees Celsius)

The graphs of FIGS. 2 and 3 illustrate typical performance data from the circuit of FIG. 1. Thus, FIG. 2 shows the variation and stability of the reference voltage Vref from M1 and the regulated output voltage Vca on output line 3, with increase of supply voltage Vin from 1 volt to 6 volts. The results of FIG. 2 were measured at 165° C. The Vref value is measured at the drain node 9 of M1 in the FIG. 1 circuit, M1 being powered from the Vca line 3 via R1. For values of Vin above 3.8V, the variation of Vref and Vca is considerably smaller than the variation of Vin, being at most a 5% change in Vca and less than a 1% change in Vref. These very small percentage variations in Vca and Vref apply up to the maximum specified Vin value for the FIG. 1 circuit of 20V. Thus, good stability is obtained, for both Vref and Vca, above 3.8 volts FIG. 3 shows the stability of the reference voltage Vref from M1 and the output voltage Vca on the output line 3, with respect to the temperature range of 20° C. to 200° C. As can be seen, good temperature stability is obtained over most of this range. The reference device M1 of zero temperature coefficient is powered from the output line 3 in the FIG. 1 circuit, and this significantly improves the stability of the reference voltage Vref by controlling the current density in M1 far more precisely than would be possible if M1 were powered from the supply line 1. The results of FIGS. 2 and 3 were obtained with M2 and M3 operating in their sub-threshold region so as to maximise the gain available from the differential amplifier.

Figure 4:
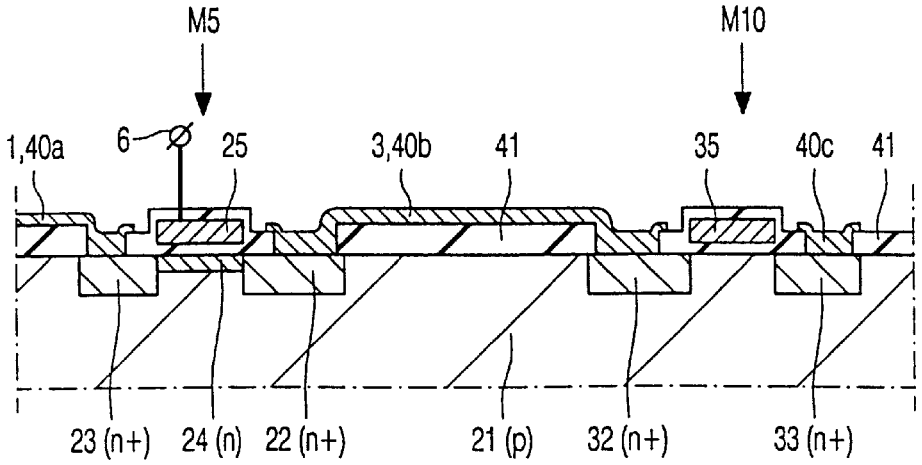
FIG. 4 is a diagrammatic cross-sectional view of part of a semiconductor body of a semiconductor circuit device in accordance with the present invention, showing how a semiconductor circuit element can be integrated with the voltage regulator circuit of FIG. 1.

The voltage regulator circuit of FIG. 1 can be readily integrated with other semiconductor circuit elements in a semiconductor circuit device, so as to provide a stable internal power supply for the circuit comprising these other circuit elements. FIG. 4 shows part of such a semiconductor circuit device comprising a semiconductor body portion 21 of one conductivity type (for example p-type) in and on which the various circuit elements are integrated. Thus, for example, the n-channel enhancement MOSTs M1 to M4 of FIG. 1 may be formed with n-type source and drain regions 22 and 23 which respectively over-dope parts of the p-type body region 21. The n-type source and drain regions 32 and 33 of other n-channel MOSTs of the semiconductor circuit device may be formed in the same process steps as the source and drain regions 22 and 23 of the FIG. 1 circuit. By way of example, FIG. 4 illustrates one such additional MOST M10 and the MOST M5 of the FIG. 1 circuit, formed side-by-side in the same p-type body portion 21 of the device body. M10 is an n-channel enhancement mode MOST. MOST M5 of FIG. 1 is a n-channel depletion device, whose n-type depletion channel 24 may be formed by donor implantation between its source and drain regions 22 and 23. The gate electrodes g of the MOSTs M1 to M5 and also of the additional MOSTs such as M10 may be formed by, for example, a doped polycrystalline silicon layer pattern 25, 35 on a gate dielectric film on the semiconductor body surface.

Conductor tracks and interconnections of the MOSTs M1 to M5, M10 etc may be formed by a metal film pattern 40*a*,40*b*,40*c* (for example of aluminium) on an insulating layer pattern 41 on the semiconductor body surface. FIG. 4 shows this metal film pattern 40*a*, 40*b*, 40*c* contacting the source and drain regions 22, 23, 32, 33 of the MOSTs M5 and M10. Thus, in the cross-section of FIG. 4, the metal film part 40*a* provides the supply line 1 of FIG. 1 connected to the drain of M5, and the metal film part 40*b* provides the output line 3 from the source 22 of M5. In the particular example illustrated in FIG. 4, the source region 32 of M10 is coupled to this output line 3, which serves to provide the voltage supply for the circuit comprising M10. The resistors R1 to R8 in FIG. 1 may be provided in known manner as thin-film resistance elements of, for example, doped polycrystalline silicon on the insulating layer 41. Such thin-film resistors have a low temperature coefficient of resistance. The diodes D1, D2 of FIG. 1 can be formed by n-type and p-type regions in polycrystalline silicon thin-film technology, or by n-type regions in the p-type body portion 21. The p-type body portion 21 may be, for example, a p-type well in a much larger semiconductor body which comprises, for example, a power semiconductor device.

Many modifications and variations are possible within the scope of the invention. Thus, for example, the circuit elements of FIG. 1 may be of opposite conductivity type (for example p-channel MOSTs M1 to M5), with an appropriate change in the polarity of the supply voltage Vin.

Figure 5:
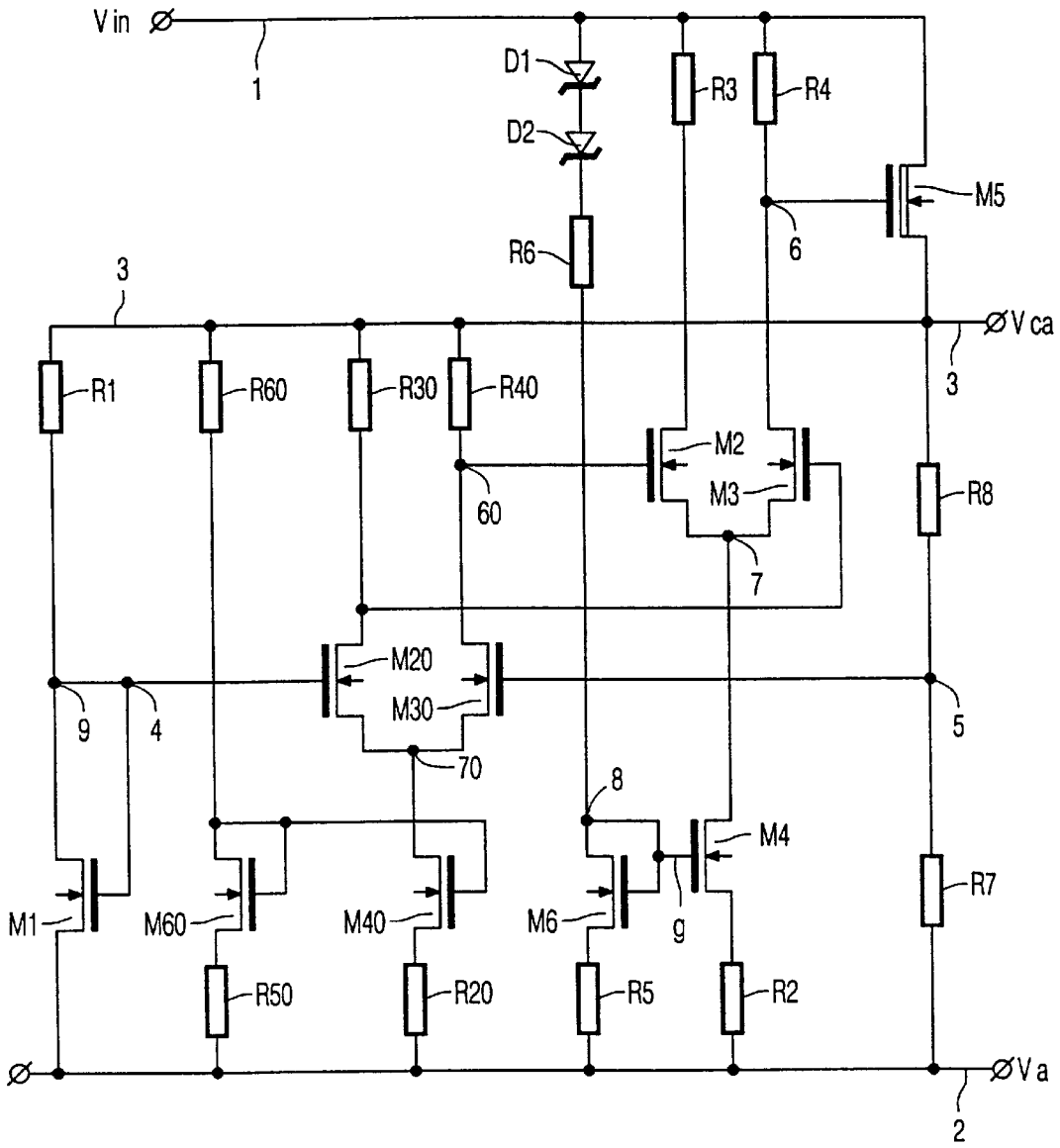
FIG 5. is a circuit diagram of a second embodiment of a voltage regulator circuit in accordance with the present invention.

FIG. 5 illustrates the use of a more complex differential amplifier, comprising cascaded amplifier stages. The input first stage comprises the first and second inputs 4 and 5, respectively from the reference device M1 and the output line 3. This input stage is powered from the output line 3 by being coupled between the output line 3 and the return line 2. In the circuit of FIG. 5, it is only the output stage of the differential amplifier which is powered from the supply line 1, by being coupled between the supply line 1 and the return line 2 via the varying current source M4. Thus, it is only to this second stage of the differential amplifier that the varying bias current from M4 is fed to provide the first-order compensation of the output voltage signal Vca for variations in the supply voltage Vin. Both the input and output stages in this FIG. 5 example are shown with similar long-tailed pair configurations (M20, M30) and (M2, M3) respectively, so as to simplify the understanding of the circuit. Thus, in this example, similar component references are used for the input stage as for the output stage, but increased by a factor 10 (e.g. M60 in the input stage and M6 in the output stage). In the FIG. 5 circuit, the tail current to the input stage pair M20 and M30 is via M40, the gate of which is coupled to the output line 3 via the impedance path comprising R60 and the current mirror M60. The FIG. 5 circuit provides more gain (between nodes 4 and 5) than that of FIG. 1 and an even smaller percentage variation in Vca with Vin. It may be used to provide a regulated supply in, for example, a monolithic analog or digital integrated circuit. However, this circuit configuration is less advantageous than that of FIG. 1, in requiring more layout area for its integration in a circuit device.

As shown in FIGS. 2 and 3, the reference voltage Vref produced at node 9 in the FIG. 1 circuit is of a significantly higher quality than the regulated output Vca on the line 3. This arises because the reference device M1 is powered from the regulated output voltage Vca. By means of a connection from node 9, a reference output Vref could be exported directly to other circuits where parameter precision is important (e.g. for a current-limiting circuit in a power device). No loading can be tolerated on the reference device M1 since the current density in this device defines the absolute value and temperature coefficient of the reference Vref. However, if export of the reference Vref were required, it could normally be done via a buffer (unit gain) amplifier, running on the regulated output Vca. Thus, in a semiconductor power device having a regulator circuit in accordance with the invention, control circuits of the device can be powered with Vca from line 3, and one or more references in these control circuits may be derived from node 9 via a buffer amplifier.

From reading the present disclosure, other modifications and variations will be apparent to persons skilled in the art. Such modifications and variations may involve equivalent features and other features which are already known in the art and which may be used instead of or in addition to features already disclosed herein. Although claims have been formulated in this Application to particular combinations of features, it should be understood that the scope of the disclosure of the present application includes any and every novel feature or any novel combination of features disclosed herein either explicitly or implicitly and any generalisation thereof, whether or not it relates to the same invention as presently claimed in any Claim and whether or not it mitigates any or all of the same technical problems as does the present invention. The Applicants hereby give notice that new claims may be formulated to such features and/or combinations of such features during prosecution of the present application or of any further application derived therefrom.

I claim:

1. A voltage regulator circuit comprising a differential amplifier powered from a supply line at a nominal voltage level by being coupled between the supply line and a return line, a reference device coupled to a first input of the differential amplifier for defining a desired output voltage on an output line coupled to an output of the differential amplifier, and a feedback coupling from the output line to a second input of the differential amplifier, characterised in that the differential amplifier is coupled to the return line by a varying current source which feeds a varying bias current to the differential amplifier, and the varying current source has control means coupled to the supply line for controlling the magnitude of the varying bias current in accordance with variations in the nominal voltage level on the supply line and so to provide a first-order compensation of the output voltage for these variations in the nominal voltage level, a second-order compensation being provided by the feedback coupling from the output line to the second input of the differential amplifier.

2. A circuit as claimed in claim 1, further characterised in that the varying current source comprises an insulated-gate field-effect transistor having its main current path coupled between the supply line and return line and having its gate forming the control means of the varying current source.

3. A circuit as claimed in claim 2, further characterised in that the insulated-gate field-effect transistor is coupled in a current mirror configuration with a diode-connected insulated-gate field-effect transistor, and this diode-connected insulated-gate field-effect transistor has its main current path coupled in an impedance path between the supply line and return line for deriving a varying reference current in accordance with variations in the nominal voltage level on the supply line, the variation in magnitude of the bias current of the differential amplifier being determined by the variation in magnitude of the reference current in the impedance path.

4. A circuit as claimed in claim 1, further characterised in that the reference device is supplied from the output line by being coupled between the output line and return line.

5. A reference voltage circuit as claimed in claim 4, further characterised in that the reference device comprises a diode-connected insulated-gate field-effect transistor having its main current path coupled in series with a resistance between the output line and return line so as to operate in an area of its square law region for providing an output voltage substantially independent of temperature.

6. A reference voltage circuit as claimed in claim 1, further characterised in that the output line is derived from the output of the differential amplifier via a source-follower insulated-gate field-effect transistor having its gate coupled to the output of the differential amplifier and having its main current path coupled between the supply line and output line.

7. A circuit as claimed in claim 1, further characterised in that the differential amplifier comprises a differential pair of insulated-gate field-effect transistors each having its main current path coupled between the supply line and return line via the varying current source and each having its gate coupled to a respective one of the first and second inputs of the differential amplifier.

8. A circuit as claimed in claim 1, further characterised in that the differential amplifier comprises first and second, cascaded amplifier stages, of which only the second stage is powered from the supply line by being coupled between the supply line and return line via the varying current source, the first stage is powered from the output line by being coupled between the output line and the return line, the first stage comprises the first and second inputs of the differential amplifier, and the output of the differential amplifier is derived from an output of the second stage.

9. A circuit as claimed in claim 1, further characterised in that the feedback coupling from the output line to the second input of the differential amplifier is derived from a potential divider coupled between the output line and return line.

10. A semiconductor circuit device comprising at least one semiconductor circuit element integrated with a voltage regulator circuit as claimed in claim 1, wherein the semiconductor circuit element is powered from the output line of the voltage regulator circuit.

* * * * *